US006364174B1

(12) United States Patent
Lohrman et al.

(10) Patent No.: US 6,364,174 B1
(45) Date of Patent: Apr. 2, 2002

(54) PUMP DISPENSER HAVING PISTON RETAINER AND STOP

(75) Inventors: Richard D. Lohrman, Sylvania; Wing-Kwong Keung; Gennaro R. Martire, both of Perrysburg; Bradley J. Kimble, Holland; Richard C. Sayers, Akron, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/789,472

(22) Filed: Feb. 21, 2001

(51) Int. Cl.[7] ..... B67D 5/40
(52) U.S. Cl. ..... 222/383.1; 222/321.8
(58) Field of Search ..... 222/383.1, 321.8

(56) References Cited

U.S. PATENT DOCUMENTS

| | | | | | |
|---|---|---|---|---|---|
| 5,156,304 | A | * | 10/1992 | Battegazzore | 222/383.1 |
| 5,207,359 | A | * | 5/1993 | Steijns | 222/383.1 |
| 5,356,049 | A | * | 10/1994 | Harris et al. | 222/383.1 |
| 5,683,014 | A | | 11/1997 | Smolen, Jr. et al. | |
| 5,749,501 | A | * | 5/1998 | Maas et al. | 222/383.1 |
| 6,234,412 | B1 | * | 5/2001 | Von Schuckmann | 222/383.1 |

FOREIGN PATENT DOCUMENTS

| | | |
|---|---|---|
| WO | WO99/11386 | 3/1999 |

* cited by examiner

*Primary Examiner*—Philippe Derakshani
*Assistant Examiner*—Thach H. Bui

(57) ABSTRACT

A piston/nozzle unit retainer and stop comprises inward fingers in the cylinder slots receiving the trigger trunions which drive the unit.

5 Claims, 3 Drawing Sheets

PUMP DISPENSER HAVING PISTON RETAINER AND STOP

FIELD OF THE INVENTION

This invention relates to pump dispensers. More specifically, the invention relates to pump dispensers of the type shown in U.S. patent application Ser. No. 09/486,887 filed Mar. 2, 2000, by Alfred von Schuckmann.

BACKGROUND OF THE INVENTION

In the structure of the dispenser disclosed in the aforementioned patent application, the pump body cylinder is horizontal, slotted on opposite sides and receives a piston/nozzle unit having outward trunion saddles. The cylinder is shrouded by a cover/trigger unit pivoted to the rear of the pump body and formed with a pair of inward horizontally aligned trunions which ride in the saddles and slide in the aforementioned slots. The cover portion and trigger portion of the cover/ trigger unit are joined by a living hinge to comprise an articulated unit so that when the trigger is pulled, the cover/trigger unit humps up at the living hinge and the trunions slide rearward pulling the piston/nozzle unit rearward with them. The piston/nozzle unit is biased forward by a helical spring compressively disposed between the piston and the end wall of the cylinder.

SUMMARY OF THE INVENTION

In the structure described, the invention is the improvement of a cut-out in the wall of the cylinder adjacent each slot and the formation there of an inward finger which resiliently permits passage of the trunions in assembly and then snaps closed and thereafter serves as a positive stop for the forward travel of the piston/nozzle unit. During assembly the retainer of the invention retains the piston/nozzle unit in the cylinder.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
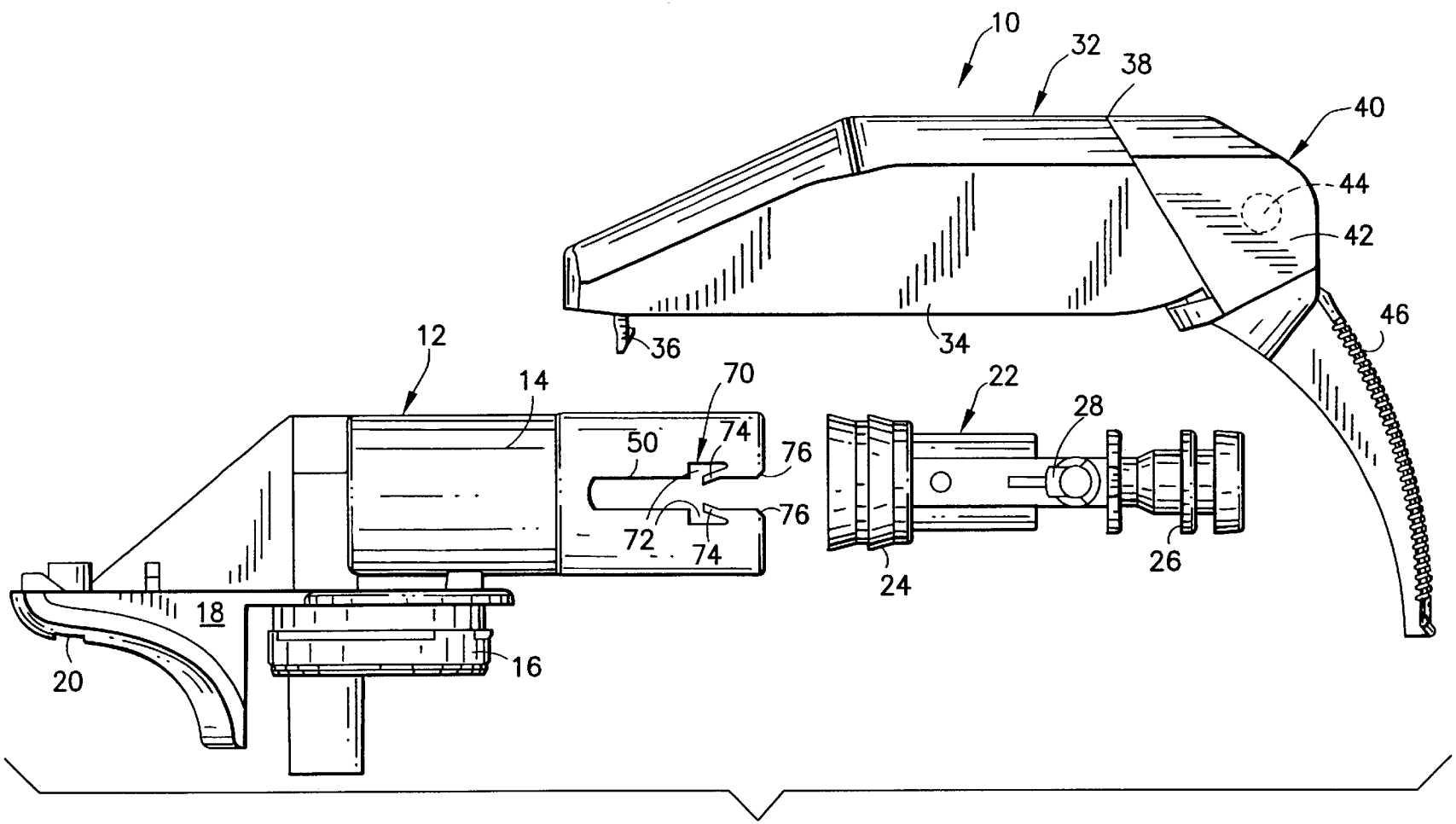
FIG. 1 is an exploded side view of a pump dispenser embodying the invention.

A dispensing pump embodying the invention is shown in FIG. 1 in exploded view. It is generally designated 10. It comprises a pump body 12 having a horizontal cylinder 14 and a closure fitment 16. It also includes a rearward support shelf 18 for the cover pivot opening 20.

Sliding into the cylinder 14 is a piston/nozzle unit 22 comprising the piston 24 and the integrally formed nozzle head 26. Lateral trunion saddles 28 are formed between the piston and the nozzle head. A cover/trigger unit is generally designated 32 and comprises a cover 34 adapted to shroud over the pump body 12, concealing the cylinder. A downward pivot hook 36 is formed at the rear of the unit 32, and is received into the pivot opening 20 of the pump body in assembly.

Integral with the cover 34 by way of a "living hinge" 38 is a trigger 40 having sides which extend parallel to and are spaced inward from the sides 42 of the cover 34. A pair of aligned inward trunions 44 extend inward from the sides 42 and a downward extension 46 constitutes the trigger lever.

Figure 4:
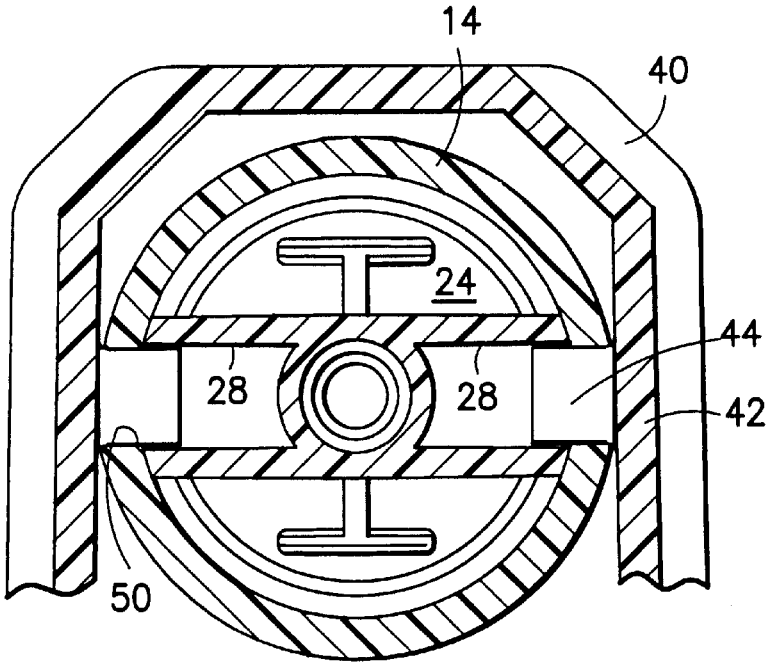
FIG. 4 is an enlarged fragmentary sectional view taken on the line 4—4 of FIG. 2.

Receiving the trunions 44 in assembly are slots 50 in opposite sides of the cylinder 14. Inward from the sides of the cylinders the trunions are received into the trunion saddles 28 in assembly (FIG. 4).

Figure 2:
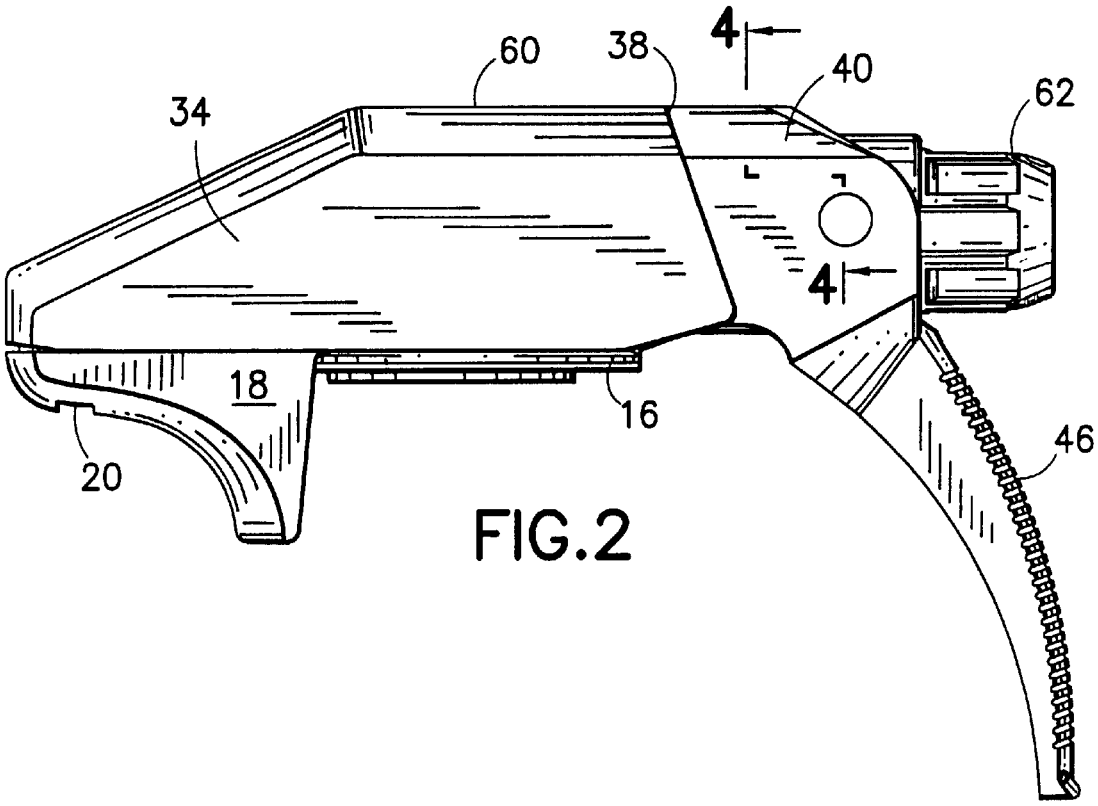
FIG. 2 is a side elevation of the assembled dispenser.

Thus, as more fully described in the von Schuckmann patent application cited above, the assembled dispenser appears outwardly as shown in FIG. 2 with a flat top 60 and downward trigger lever 46 with the nozzle cap 62 rotatably snapped over the nozzle head 26. A closure (not shown) having a conventional opening in its top wall is secured onto the fitment 16 in snap assembly. The container of liquid to be dispensed, also not shown, extends downward from the closure.

The user can conveniently grip the container and with her fingers over the trigger lever 46 can activate the pump by pulling the trigger lever 46. As the trigger lever 46 is pulled, the top 60 humps up at the living hinge 38, the top of the cover 32 forming a tension element between the hinge 38 and the pivot hook 36 moving the trunions 44 in slots 50 along with the piston/nozzle unit 22 rearward to effect pumping of liquid from the container out the nozzle cap 62. When the piston 24 reaches its rearward position in the cylinder, the trigger lever 46 may be released and a helical spring (not shown) within the cylinder 14 urges the piston forward, restoring the cover/trigger unit to its position shown in FIG. 2.

Figure 3A:
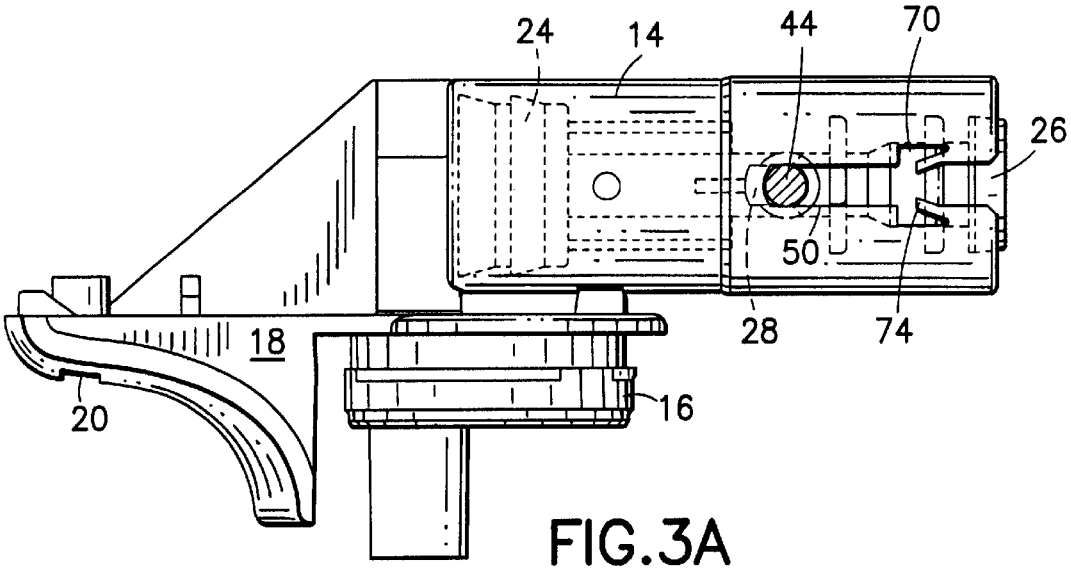
FIG. 3A is a side elevation of the pump body with the piston/nozzle unit, shown partly in broken lines, in its rearward position. Also shown in section is the trunion of the trigger.
Figure 3B:
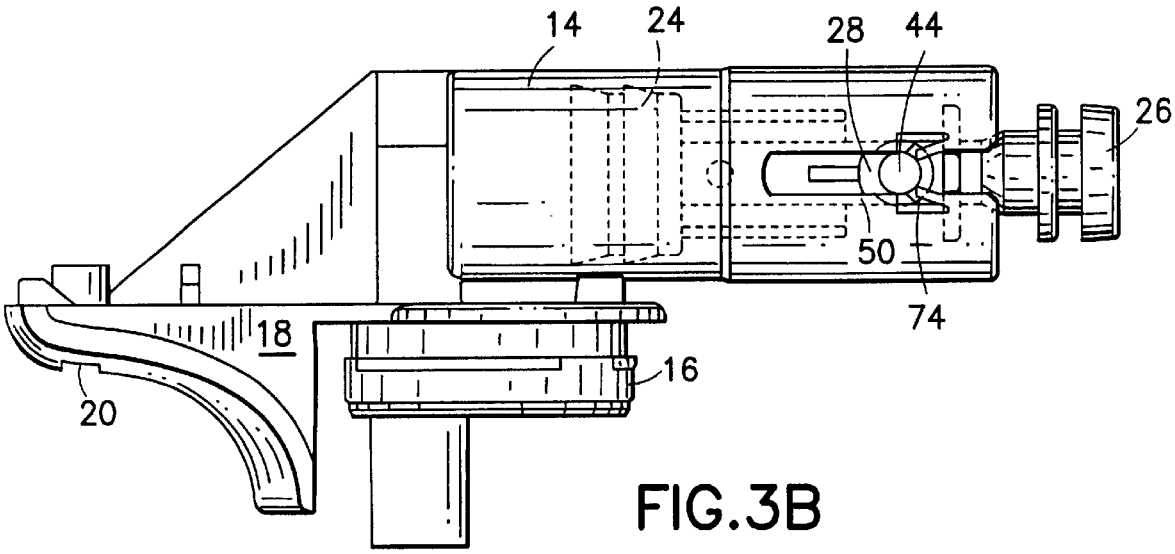
FIG. 3B is a view similar to FIG. 3A showing the piston in forward position.

Attention is now invited to the piston/nozzle retainer 70 comprising the invention. It will be noted from FIGS. 1, 3A and 3B that the slot 50 in the cylinder 14 is formed spaced forward from its rearward end with a uniquely shaped cut-out 74, upwardly and downwardly enlarging the slot. Toward the forward end of the cut-out 72 inward fingers 74 extend rearward and inwardly of the slot 50 beyond the margins of the slot. The ample cut-out 72 gives the fingers 74 room to flex outward.

In assembly, with the trunions 44 receiving the trunion saddles 28 respectively on the opposite sides of the piston/nozzle unit, the trunions are aligned with the slot 50 and enter it, guided by the entry chamfers 76. When the trunions engage the fingers 74, the fingers 74 flex outward, yielding to permit passage of the trunions 44 (FIG. 4). When the trunions pass the fingers, the fingers snap back to their original position (FIGS. 1, 3A, 3B) and thereafter form a stop, limiting the forward travel of the trunions 44 (FIG. 3B) and piston/nozzle unit.

There is thus provided an automatically established piston/nozzle retainer and stop for the forward movement of the piston/nozzle unit.

Clearly, variations of the structure shown are possible.

For instance, a single finger may be used in only one or both of the slots. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A pump dispenser comprising:

a. a pump body defined by a cylinder having slots in opposite sides thereof, the slots having margins, b. a piston/nozzle unit operable in the cylinder, c. an articulated cover/trigger unit comprising a cover portion and a trigger portion joined by a living hinge and pivoted at a rear point on the cover portion to a rear point on the pump body, the trigger portion defined by inward trunions extending into the respective slots and engaging the piston/nozzle unit, the slots being formed with at least one resilient finger extending from a margin of the slot and inclined rearward into the slot defining the slot at the finger as narrower than the trunion sliding in it.

2. A pump dispenser as claimed in claim 1 wherein each slot is formed with opposing resilient inward and rearward fingers.

3. A pump dispenser as claimed in claim 1 wherein the margin of the slot adjacent the finger is cut out to afford the finger freedom to flex outward.

4. In a pump dispenser comprising:

a. a pump body having a front end and a rear end and a downward portion for mounting on a container, the pump body comprising a pump cylinder having an open end facing the front end of the body and formed with slots along opposite sides of the open end;

b. a piston/nozzle unit reciprocable in the open end of the cylinder;

c. a trigger/cover unit comprising a cover portion having a forward and a rearward end, the rearward end being hingedly connected to the rear end of the pump body, and a trigger portion having an upper end, an intermediate portion and a lower end, the upper end being hingedly connected to the forward end of the cover portion, the intermediate portion having inward trunions extending through the slots pivotally connected to the piston/nozzle unit, the lower end of the trigger portion serving as a trigger lever, the improvement wherein one of the slots is formed with a resilient inward and rearward finger decreasing the width of the slot in the area of the finger to less than the corresponding dimension of the cooperating trunion.

5. A method of assembling a pump dispenser comprising:

a. providing a pump body having an open front end and a rear end and a downward portion for mounting on a container, the pump body having a pump cylinder fixedly disposed on the body and having the open end facing the front end of the body and formed with slots along opposite sides of the open end and at least one resilient inward and rearward finger formed in the margin of a slot, b. providing a piston/nozzle unit for reciprocation in the open end of the cylinder, the piston/nozzle unit having trunion saddles intermediate its ends, c. providing a trigger/cover unit comprising a cover portion having a forward and a rearward end, and a trigger portion having an upper end, an intermediate portion and a lower end, the upper end being hingedly connected to the forward end of the cover portion, the intermediate portion having inward trunions, the lower end of the trigger portion adapted to serve as a trigger lever, d. engaging the trunions on the cover/trigger unit with the trunion saddles on the piston/nozzle unit, e. inserting the piston/nozzle unit into the cylinder with the trunions aiding in the respective slots past a depth at which the trunion snaps past the finger, and f. pivotally attaching the rear end of the cover portion to the rear end of the pump body.

* * * * *